US005454987A

United States Patent [19]

Cornwell, Jr.

[11] Patent Number: 5,454,987

[45] Date of Patent: Oct. 3, 1995

[54] SPLASH BAR FOR COOLING TOWER

[75] Inventor: Lawrence E. Cornwell, Jr., Houston, Tex.

[73] Assignee: Cooling Tower Technologies, Inc., White Castle, La.

[21] Appl. No.: 320,945

[22] Filed: Oct. 11, 1994

[51] Int. Cl.[6] ..... B01F 3/04

[52] U.S. Cl. ..... 261/111; 261/DIG. 11

[58] Field of Search ..... 261/111, DIG. 11

[56] References Cited

U.S. PATENT DOCUMENTS

| | | | |
|---|---|---|---|
| 3,389,895 | 6/1968 | De Flon | 261/11 |
| 3,647,191 | 3/1972 | Fordyce | 261/111 |
| 3,758,088 | 9/1973 | Fordyce | 261/111 |
| 4,133,851 | 1/1979 | Ovard | 261/111 |
| 4,181,691 | 1/1980 | Cates et al. | 261/111 |
| 4,439,378 | 3/1984 | Ovard | 261/111 |
| 4,557,878 | 12/1985 | Fulkerson | 261/111 |
| 4,576,764 | 3/1986 | Shepherd et al. | 261/111 |
| 4,578,227 | 3/1986 | Ovard | 261/111 |
| 4,705,653 | 11/1987 | Stackhouse et al. | 261/111 |
| 5,104,588 | 4/1992 | Kinney, Jr. | 261/111 |
| 5,185,105 | 2/1993 | Peterson | 261/111 |

*Primary Examiner*—Tim R. Miles

*Attorney, Agent, or Firm*—Robert C. Tucker; William David Kiesel; Russel O. Primeaux

[57] ABSTRACT

A splash bar is provided for use in a water cooling tower, the splash bar comprising an elongated body portion having a tubular central rib and a plurality of wing members, each wing member extending laterally from the central rib, the wing members each having a plurality of apertures therethrough. The surface formed by the wing members is preferably sloped, and the tubular central rib preferably has a triangular cross section.

12 Claims, 2 Drawing Sheets

10
6
18
20
19
14
20
12
15
4
16
13
8
9
15
5
9
4
16

3
13
6
14
5
8
12
16
8
4
15
17
10
17
15
16
1
4
3
1
11
17
2

SPLASH BAR FOR COOLING TOWER

BACKGROUND OF THE INVENTION

This invention relates to splash bars, sometimes referred to as fill slats, used in conjunction with falling water cooling towers.

The use of splash bars in cooling towers is well known in the art. The splash bars are positioned in a cooling tower by a means such as a wire hanger system. The splash bars typically are arranged in a matrix wherein the splash bars are offset both vertically and horizontally. Warmer water is introduced at the top of the cooling tower and distributed over the top layer of splash bars. As the water droplets fall downward, the surfaces of the droplets are subject to evaporation which cools the droplets. By breaking up large droplets and by providing a surface on which water can form a thin film, the splash bars increase the surface area of water exposed to air, and hence the evaporation rate. The evaporation process is enhanced by inducing air flow, typically by means of fans, across the splash bars. Typically, the air flow is induced parallel to the longest dimension of the splash bars (cross flow). However, an air flow can be induced such that the air flows from below the splash bars (counter flow). When the cooled water reaches the bottom of the tower, it is collected in a basin and brought into contact with the relatively warmer medium it is intended to cool. The water, warmed by the heat transferred to it, is then returned to the top of the tower to repeat the process.

In the past, splash bars have been constructed of wood. However, wooden splash bars tend to be subject to deterioration. While metal splash bars have been used, their use is often not economical. The use of splash bars constructed of a plastic material is now well known in the art. These splash bars are produced with perforations on the surfaces normal to the flow of water. Examples of this can be seen in U.S. Pat. Nos. 4,133,851 to Ovard and 5,104,588 to Kinney. One continuing difficulty encountered in the art is the tendency of splash bars to deform along their longitudinal axes. Numerous designs have been disclosed to strengthen the bar. One attempted solution was to provide a solid, longitudinal, rectangular, central rib extending the length of the of the splash bar in order to increase the splash bar's strength. See U.S. Pat. Nos. 4,133,851 and 4,439,378 to Ovard, and 5,104,588 to Kinney. Additionally, the use of a V-shaped rib member was disclosed in U.S. Pat. No. 4,576,764 to Shepherd. However, deformation problems persist, even in the newer designs with central ribs.

An additional difficulty encountered in the prior art is effectively securing the splash bars to the wire hanging system. One solution was the use of clips to fix the edges of the splash bar to the hanging wires. See U.S. Pat. No. 4,576,764 to Shepherd. This method has the disadvantage of being highly labor intensive and therefore not cost efficient.

SUMMARY OF THE INVENTION

This invention provides several advantages over the prior splash bars as is more fully explained below.

It is an object of this invention to provide a splash bar which resists deformation.

It is another object of this invention to provide a splash bar with increased resistance to deformation and which discourages pooling of water on the splash bar surface.

One of the main advantages of the invention lies in the improved central rib which comprises a closed triangular section, which provides a considerably stronger support member than hereto known in the art.

As a result of having a stronger central support member, less strength is needed in the portion of the splash bar that is normal to the flow of water. Therefore this portion may contain more perforations to more uniformly break up the water flow.

Another main advantage resides in an improved means of securing the splash bar to the wire hanging system. This means comprises an improved notch, which allows workers to quickly "snap" the splash bars into the wire hanging system, thereby substantially reducing labor costs.

The sloped surface of the splash bar also provides further support without sacrificing surface area normal to the water flow.

The sloped surface of the splash bar prevents water droplets from collecting on the splash bar. Rather, the droplets tend to run off of the splash bar leaving only a desirable thin film of water.

The present invention also provides different sized apertures allowing for the more efficient distribution of water.

Other advantages may be seen by those skilled in the art.

DETAILED DESCRIPTION OF THE PREFERRED EMBODIMENTS

Figures 1, 2:
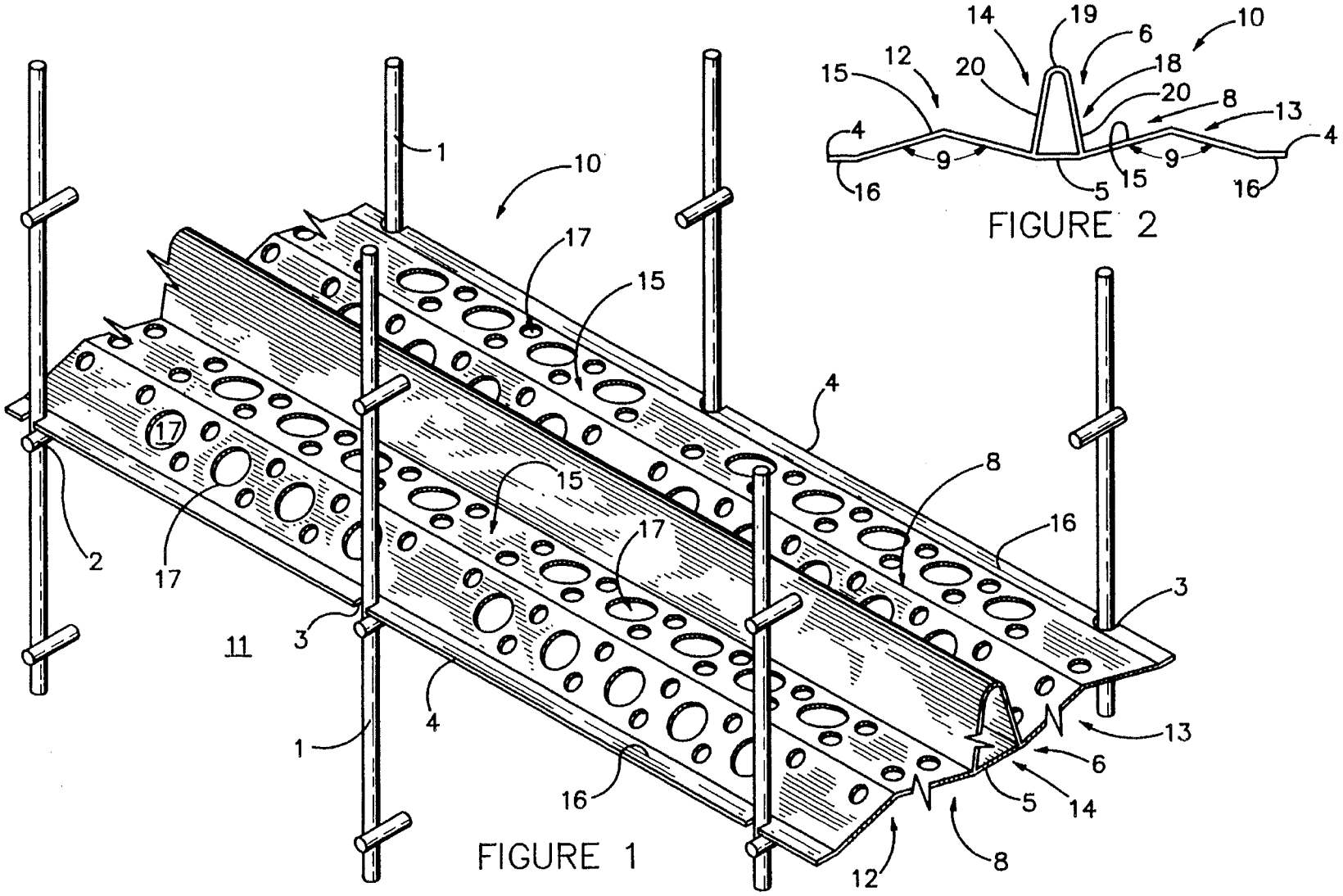
FIG. 1 is a perspective view of an embodiment of the invention in place within the interior of a cooling tower.
FIG. 2 is a end view of the embodiment shown in FIG. 1.

Referring to FIG. 1, a splash bar 10 is positioned in the interior 11 of a cooling tower (not shown). Splash bar 10 is supported by vertical support wires 1 and horizontal support wires 2, which are attached by any conventional means (such as welding) to vertical support wires 1. The system of support wires is well known in the art and does not comprise part of the present invention. Other means for supporting splash bars 10 may be used with the interior 11 of a cooling tower. Splash bar 10 engages support wires 1,2 by way of notches 3, formed in the outer edges 4 of the splash bar 10.

The invention envisions two different configurations of notches 3. In one configuration, notches 3 may be formed as in FIG. 1, with the notches 3 being open. In this embodiment, clips similar to those disclosed in the above mentioned U.S. Patent to Shepherd may be used to prevent vertical support wires 10 form dislodging from notches 3. However, such clips do not form part of this invention.

Figure 3:
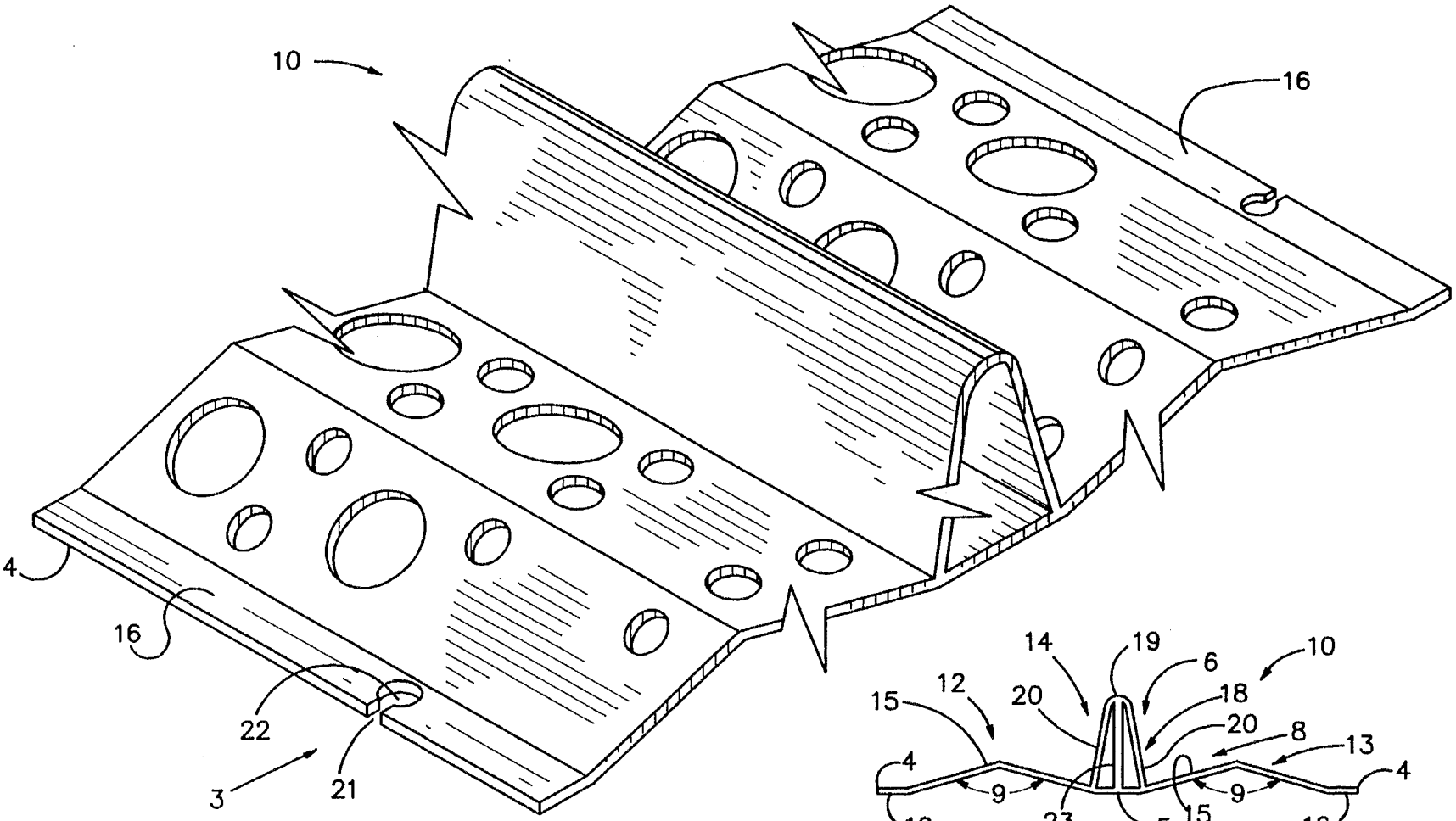
FIG. 3 is a perspective view of an embodiment illustrating the improved means for securing the splash bar to the wire hanging system.

In another configuration, as seen in FIG. 3, notches 3 have a substantially closed a mouth 21. In this embodiment, a narrow channel, generally narrower in width than the diameter of vertical supporting wires 1, is formed in outer edge 4 of splash bars 10. This channel opens into interior 22, said interior 22 being of sufficient dimension to accommodate vertical supporting wires 1. The substantially closed mouth 21 of the notches 3 will resiliently bend when supporting wire 1 is pressed through mouth 21 into interior 22 of notch 3. After supporting wire I is pressed through mouth 21 of notch 3, mouth 21 returns to its substantially closed position, securely engaging supporting wire 1 with splash bar 10.

In practice, a horizontal layer of splash bars 10 is placed between every other pair of vertical wires 1. A next lower layer of splash bars 10 is placed between alternate pairs of vertical wires 1, with outer edges 4 of splash bars 10 in one layer slightly overlapping the outer edges 4 of splash bars 10 in the next or preceding layer(s). This placement forms a matrix or check-work pattern typical in the art. However, in some applications, splash bars may be placed without alternating between pairs of vertical wires. Splash bars 10 normally vary in length from 4 feet to 8 feet depending on the cooling tower in which they are to be placed. However, longer or shorter splash bars 10 can be manufactured when specifically needed to meet the requirements of a particular tower.

The main body 8 of splash bar 10 comprises wing members 12,13 extending laterally on both sides from a central portion 14 that corresponds with a tubular central rib. Wing members 12,13 typically extend approximately 2 ¼ inches from central portion 14 and have a thickness of approximately 0.050 inches, although these dimensions may vary. The body 8 and rib 6 sections will generally be integrally formed from a thermoplastic material such as polyvinylchloride, but can be formed from other suitable material. Such materials could include ABS, polypropylene, or CPVC when the splash bars are required to withstand elevated temperatures. Body 8 forms a somewhat flattened M-shaped cross section by incorporating two obtuse angles 9. In a preferred mode, obtuse angles 9 are about 110 to 130 degrees, but could vary between 90 and 180 degrees. The cross-sectional shape of body 8 results in a sloped splash bar surface 15. Although a small outer portion 16 of surface 15 may be flattened for connection to support wires 1,2, the majority of surface 15 is sloped. The sloped, M-shaped cross section is a structural improvement over prior art splash bars which had substantially fiat body portions. Since the sloped cross section has a vertical dimension, it provides a greater moment of inertia to resist deformations along the longitudinal axis of splash bar 10. An additional benefit of sloped surface 15 is its tendency to inhibit the retention of water droplets. The prior art splash bars typically have the majority of the body portion in a horizontal plane. This configuration allows droplets to remain on the body or "bead up" on that surface. Since the majority of body portion 8 of the present invention possesses some slope, droplet accumulation is inhibited. As the droplets run off of body portion 8, a thin film of water remains. This thin film is highly desirable from the standpoint of evaporation efficiency. The preferred M-shaped cross section also provides greater surface area for cooling.

Body 8 is further provided with a plurality of apertures 17. A preferred embodiment has alternating rows of smaller and larger circular apertures 17, with the larger apertures having an approximate diameter of ⅜ inch and the smaller apertures having a diameter of approximately ¼ inch. It is understood that this is only one embodiment and many other aperture dimensions and arrangements are possible. This is an improvement over the prior art since the combination of different diameters tends to more thoroughly break up the water droplets. As a result, the lower splash bars tend to receive a more random spray pattern of water rather than the more uniform flow experienced when the apertures 17 are all of one size.

Outer portions 16 typically will be integrally formed with body 8 and will lie in a plane that is substantially parallel with the base 5 of the central rib 6. Outer portions 16 are approximately ½ inch in width in a preferred embodiment, but may be narrower or wider according to design preference. Outer portions 16 typically do not have apertures 17 other than notches 3 formed therein for engaging hanging wires 1,2. As stated above, outer edges 4 of a particular splash bar 10 will tend to overlap outer edges 4 of splash bar(s) in the level below or above it. This assists in insuring the water droplets strike as many surfaces as possible as the droplets travel through the cooling tower.

Tubular central rib 6 is preferably integrally formed with body portion 8. As will be understood by those skilled in the art, the tubular cross section of rib 6 provides superior strength over the prior art rib members. This improved strength can approach twice that exhibited by some prior art splash bars. Tubular central rib 6 may take various cross-sectional shapes, such as circles, rectangles, triangles, etc. In a preferred embodiment depicted in FIGS. 1–3, tubular central rib 6 has a cross section forming a triangle 18 having a rounded apex 19. In the embodiment shown, triangle 18 is preferably approximately 1 inch in height, has a base 7 approximately ½ inch wide. The other sides 20 of triangle 18 are preferably of equal length. The sides of triangle 18 are of a thickness comparable with that of body portion 8. When the term "triangle" is used herein, it is not intended to connote a geometrically perfect shape. Rather, the term represents a three-sided, generally triangular shape. For example, apex 19 may be somewhat rounded as seen in the Figures.

Figure 4:
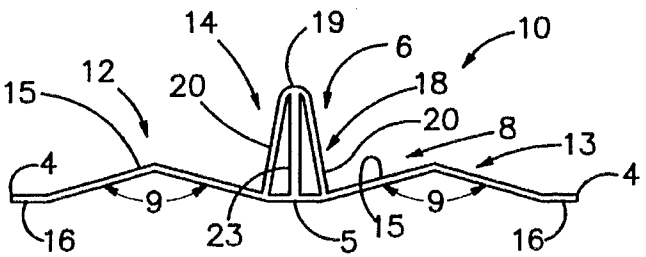
FIG. 4 is an end view of another embodiment having a vertical, central support member.

Another embodiment is depicted in FIG. 4, which includes a central support member 23. Central support member 23 is integrally formed with central rib 6 and rises vertically from base 5 to join apex 19. Central support member 23 is of approximately the same thickness as the other portions of splash bar 10 and its length is coextensive with the length of the central rib 6.

As can be seen, a splash bar is provided having novel improvements and advantages over the prior art. Upon a review of this specification, those skilled in the art may envision other embodiments of the invention, which are intended to be included within the scope and spirit of the following claims.

I claim:

1. A splash bar for use in a water cooling tower, said splash bar comprising an elongated body portion having a tubular central rib and a plurality of wing members, each said wing member extending laterally from said central rib, said wing members each having a plurality of apertures therethrough.

2. A splash bar according to claim 1, wherein said splash bar is formed of extrudable, thermoplastic material.

3. A splash bar according to claim 1, wherein each said wing member is provided with a splash bar surface, the majority of which is sloped.

4. A splash bar according to claim 3, wherein a cross section of said body is substantially M-shaped.

5. A splash bar as recited in claim 1, wherein said apertures are of a plurality of different diameters.

6. A splash bar according to claim 5, wherein said apertures are arranged in alternating rows with each said aperture in said row having the same diameter, and wherein each said row includes said apertures having a diameter different from the preceding said row.

7. A splash bar according to claim 1, wherein each said wing member has an outer edge, each said outer edge further having a plurality of notches.

8. A splash bar according to claim 7, wherein said notches have a substantially closed mouth portion and an interior portion.

9. A splash bar according to claim 1, wherein said tubular rib member has a substantially triangular cross section.

10. A splash bar according to claim 9, wherein said tubular rib has a vertically oriented central support member bisecting said triangular cross section.

11. A splash bar according to claim 9, wherein each said wing member is provided with a splash bar surface, the majority of which is sloped.

12. A splash bar according to claim 11, wherein a cross section of said body is substantially M-shaped.

* * * * *